United States Patent [19]

Heasman

[11] 4,114,344

[45] Sep. 19, 1978

[54] CONCRETE REINFORCEMENT SPLICE WITH LOCATION TAB

[75] Inventor: Edward E. Heasman, Epping, Australia

[73] Assignee: Imoco-Gateway Corporation, Chicago, Ill.

[21] Appl. No.: 679,068

[22] Filed: Apr. 21, 1976

[51] Int. Cl.[2] ..... E04C 3/30; E04G 21/00; E04H 12/16

[52] U.S. Cl. ..... 52/741; 52/105; 52/722; 52/726; 403/27; 403/313

[58] Field of Search ..... 52/722, 726, 300, 301, 52/648, 687, 677, 600, 283, 252, 295, 730, 600, 465, 105, 741; 403/313, 303, 308, 27

[56] References Cited

U.S. PATENT DOCUMENTS

| | | | |
|---|---|---|---|
| 1,689,281 | 10/1928 | Forssell | 52/726 X |
| 1,970,422 | 8/1934 | Foster | 52/726 |
| 2,850,310 | 9/1958 | Combs | 403/27 |
| 3,245,189 | 4/1966 | Reiland | 52/722 X |
| 3,245,190 | 4/1966 | Reiland | 52/722 X |
| 3,340,664 | 9/1967 | Reiland | 52/722 X |
| 3,340,667 | 9/1967 | Reiland | 52/722 |
| 3,367,084 | 2/1968 | Reiland | 52/722 X |
| 3,473,285 | 10/1969 | Reiland | 52/741 |

FOREIGN PATENT DOCUMENTS

| | | | |
|---|---|---|---|
| 430,999 | 8/1967 | Switzerland | 52/687 |
| 998,412 | 7/1965 | United Kingdom | 403/313 |

*Primary Examiner*—Alfred C. Perham
*Attorney, Agent, or Firm*—Kinzer, Plyer, Dorn & McEachran

[57] ABSTRACT

An improved clamp and method for forming a rebar joint in a vertical reinforced concrete body. A split-sleeve type clamp with contraction means for firmly closing it around the engaged end portions of a dowel rebar and extension rebar has a location tab struck from a central portion of the sleeve, projecting upwardly and inwardly at an acute angle to engage the upper edge of a dowel rebar onto which the sleeve is driven. The method includes forming a sleeve type clamp with a location tab, driving the same onto the end of a dowel rebar directly to its operative clamping position, inserting an extension rebar in the sleeve, and contracting the sleeve to complete the joint.

9 Claims, 7 Drawing Figures

UP
10
11
12
13
14
15
16
17
18
20
21
22
23
24
25
27
28
29
30
31
32
3

CONCRETE REINFORCEMENT SPLICE WITH LOCATION TAB

BACKGROUND OF THE INVENTION

The present invention relates in general to reinforced vertical concrete structures and, more specifically, to an improved method and clamp for splicing an extension rebar onto the top of a dowel rebar to form a joint in the reinforcement of a vertical column, wall, or like reinforced concrete body.

Clamps for splicing reinforcing bars within a vertical concrete structure, and methods for doing the same, are well known, particularly as shown in Reiland U.S. Pat. Nos. 3,245,189, 3,245,190 and 3,340,667. The clamps shown therein have performed most satisfactorily in use, both in terms of strength and durability. The present invention is directed to a further improved clamp and a new method of installing the same which is designed to minimize and simplify the effort and manpower required to form rebar splices in a vertical concrete structure, such as a column or wall.

Heretofore, rebar clamps have customarily been installed by first slipping a longitudinally split sleeve over the top of a dowel bar already in place, then sliding the sleeve downwardly to expose the top surface of the dowel rebar above the sleeve. An extension rebar is then lowered into alignment with and seated on the upper end of the dowel rebar. The sleeve is then manually raised to a position embracing the adjacent ends of both bars and a wedge hand-tightened over the sleeve flanges to maintain the sleeve in position on the rebars. The correct position is found by observation through an inspection hole in the sleeve, i.e., centering the inspection hole at the engagement of the bar ends. Finally, the wedge is driven home with a sledge hammer and the splice checked for tightness before releasing the upper bar from its temporary support.

Although such method and splices have been quite successful, commercially, they present one particular problem incidental to their use. It is difficult to prevent the clamp sleeve from slipping down on the dowel bar while hammering the wedge into place. Initially, the sleeves were held manually during the entire splicing operation. Later, a clamping bolt or set screw was added to the sleeve to hold the sleeve in place. But clamping bolts or set screws add materially to the sleeve cost and require a time-consuming manual operation for application.

SUMMARY OF THE INVENTION

In accordance with the present invention, the sleeve of the rebar clamp is modified in such a way that it may be quickly and easily positioned on the dowel bar in its final splice position prior to insertion of an extension rebar into the top end of the sleeve. The method of installing the clamp is thus simplified, allowing an ironworker to easily position the clamp sleeve on the rebar during installation.

Accordingly, an important object of the present invention is a rebar clamp including location means for positively positioning a clamp sleeve on the upper end of a dowel rebar prior to insertion of an extension rebar into the sleeve, which location means may be engaged quickly, easily and with a minimum of manual dexterity.

Another important object of the invention is an improved method of forming a rebar joint according to which a clamp sleeve may be quickly and easily driven onto a dowel rebar directly to its final splice position prior to insertion of an extension rebar in the sleeve.

According to the invention, the improved clamp includes a contractable metal sleeve having a longitudinal split and an unstressed internal diameter just large enough to receive a given size rebar, and contraction means for pulling the opposed edges of the split sleeve toward each other to contract the sleeve into firm gripping relation with the end portions of a dowel rebar and an extension rebar extending into the sleeve from opposite directions. A location tab is struck from the central portion of the sleeve and projects upwardly and inwardly at an acute angle within the sleeve; the tab has sufficient strength and thickness so that a substantial driving force, such as a forceable hammer blow, is required to drive the sleeve onto a dowel rebar to a position in which the location tab is bent outwardly toward the sleeve enough to permit the tab to firmly engage the dowel rebar just below its upper edge.

The method of forming such a rebar joint in a vertical reinforced concrete body includes fabricating a contractable metal sleeve clamp with contraction means for closing the sleeve about a pair of engaged rebars and a location tab, integral with the sleeve, projecting upwardly and inwardly from the central portion of the sleeve at an acute angle; and sliding the metal sleeve onto the upper end of the dowel bar until the tab engages the upper edge of the dowel bar. The metal sleeve is driven onto the dowel rebar to bend the upper end of the location tab outwardly toward the sleeve until the tab firmly engages the dowel rebar just below its upper edge, and the extension rebar is inserted into the top of the sleeve to engage the upper end of the dowel rebar. Upon contracting the sleeve to grip both rebars, a rigid and complete rebar joint is formed.

DESCRIPTION OF THE PREFERRED EMBODIMENT

Figures 1, 2, 3, 4, 5, 6, 7:
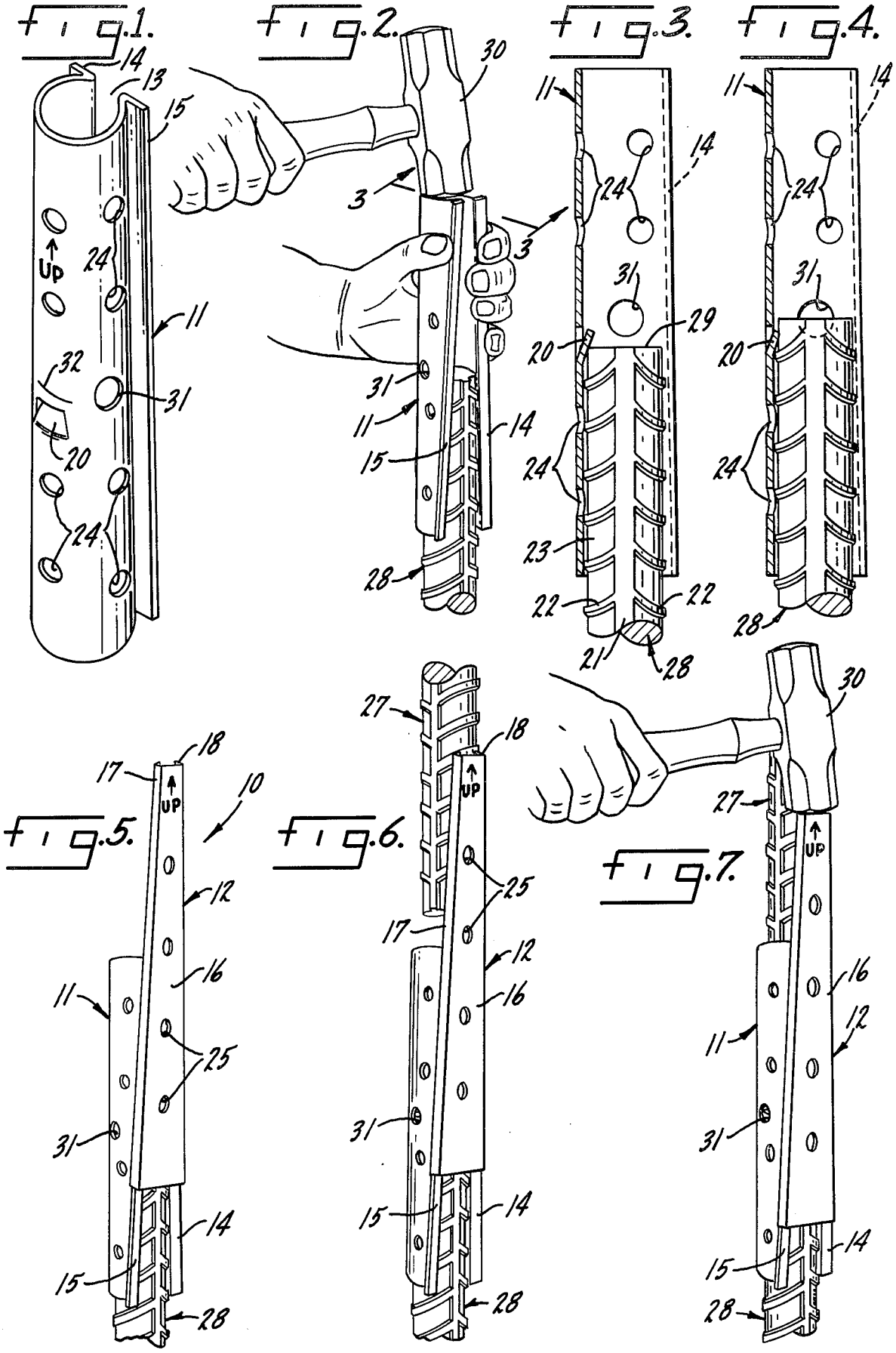
FIG. 1 is a perspective view of the sleeve structure of the invention showing the location tab struck into the same.
FIG. 2 is a perspective view of the sleeve structure in its preliminary installation position with the location tab engaging the upper edge of the dowel rebar and illustrating the manual method of driving the sleeve further onto the rebar.
FIG. 3 is a sectional view taken approximately on line 3—3 of FIG. 2 showing the sleeve at its initial position on the dowel rebar.
FIG. 4 is a sectional view, similar to FIG. 3, showing the sleeve in its final position on the dowel rebar.
FIG. 5 is a perspective view showing a wedge placed on the sleeve in its position indicated in FIG. 4.
FIG. 6 is a perspective view showing the insertion of an upper rebar into the clamp, positioned as in FIG. 5.
FIG. 7 is a perspective view showing the dowel and upper rebars in contact and the wedge being driven down onto the sleeve to firmly contract it about the rebars.

A clamp 10 and method for splicing an extension rebar onto a dowel rebar to form a rebar joint in a vertical concrete body are illustrated in FIGS. 1–7. Clamp 10 includes a split sleeve 11 and a cooperating wedge member 12. The longitudinal edges (FIG. 1) of the sleeve 11 along the slit 13 are turned laterally in opposite directions to form two wedge-engaging flanges 14 and 15. Sleeve 11 has an unstressed internal diameter just large enough to receive a given size rebar, the sleeve diameter being slightly larger than the diameters of the rebar ends to be spliced. The sleeve 10 is sufficiently flexible to yield circumferentially.

The wedge member 12 is a unitary structure slightly longer than the sleeve element 11. It comprises a flat plate 16 (FIGS. 5–7) having divergent edges which are bent inwardly to provide hook-shaped longitudinal flanges 17,18 for interlocking engagement with substantially the entire length of the outturned sleeve flanges 14,15. The wedge flanges 17 and 18 cooperate with the sleeve flanges 14 and 15 to pull the opposed edges of the split sleeve 11 together in response to forced lengthwise movement of the wedge onto the sleeve, as described in greater detail below. Thus, the function of wedge 12 is to draw the side walls of sleeve 11 in a wrap-around constrictive fashion into firm gripping relation with the end portions of a dowel rebar and an extension rebar extending into the sleeve from opposite directions.

A location tab 20 (FIGS. 1,3 and 4) is struck from the central portion of the sleeve 11 integral with the sleeve. Tab 20 projects upwardly and inwardly from the central portion of the sleeve, at an acute angle. In the preferred embodiment, the tab has a generally trapezoidal shape, including a wider base integral with the sleeve, upwardly converging sides, and a top edge generally parallel to and narrower than the base. This shape is preferred because of its wide connection to the sleeve and its general suitability for the purpose of the tab. Its central position on sleeve 11 places it longitudinally just below the center of the sleeve and generally diammetrically opposite the longitudinal slit 13. It may be desirable in some instances, to provide more than one location tab, in which case they may be circumferentially spaced around the sleeve, preferably uniformly, at the same longitudinal position.

The rebars to be spliced may be constructed according to various designs; the typical rebars shown in the drawing include longitudinal and transverse deformation ribs 21 and 22. Other deformation patterns may be used. The deformation ribs define the perimeters of the bars as gripped by the clamp 10.

Sleeve 11 is provided with a series of apertures 24 which are arranged in closely spaced relation throughout the length and circumference of the sleeve. The apertures 24, in addition to increasing the flexibility of the sleeve 11, constitute passageways through which concrete grout, during the formation of the concrete body, flows into the sleeve to fill the channels 23 of both bar ends embraced by the sleeve. The hardened grout within the channels 23 forms key-like interlocks to transmit stress from one rebar to the other through the sleeve.

Similarly, the flat portion 16 of the wedge member 12 has formed therein a series of apertures (FIGS. 5–7) designated 25 which are similar to the apertures 24 and function as auxiliary passageways for delivering grout into the channels of both rebar ends and through the slit opening 13 in the sleeve element 11.

Sleeve 11, having an unstressed internal diameter just large enough to receive a given size rebar as previously indicated, may be slid onto a dowel rebar 28 until the location tab 20 engages the upper edge 29 of the dowel rebar, as indicated in FIG. 3. Sleeve 11 is thus self-supported on the top edge of the dowel rebar. To move sleeve 11 to its operative position, the sleeve is driven further on to the upper end of rebar 28, bending the upper end of tab 20 outwardly toward the sleeve until the tab firmly engages the dowel rebar just below its upper edge 29 (FIG. 4). Sleeve 11 has a sufficient strength and thickness that a substantial driving force, such as a forceful blow by a hammer 30 (FIG. 2), is required to drive the sleeve onto the dowel rebar from its initial position (FIG. 3) to its final position (FIG. 4). An inspection hole 31 (FIGS. 1,3 and 4) is formed in the side of sleeve 11, just above the top of tab 20. The center of inspection hole 31 is aligned with the top edge 29 of rebar 28 when sleeve 11 is in its final position on the dowel rebar. As a visual aid to the ironworker, a transverse position line 32 may be stamped into sleeve 11 directly above tab 29, intersecting the center of the inspection hole 31. A pair of diammetrically opposed inspection holes 31 may be provided so that one or the other is visible to the worker regardless of his working position.

With sleeve 11 properly positioned on the upper end of the dowel rebar 28, wedge 12 is loosely slid onto the sleeve with the wedge flanges 17 and 18 engaging sleeve flanges 14 and 15. This preliminary placement of the wedge on the sleeve facilitates insertion of the lower end of an extension rebar 27 into the upper end of sleeve 11.

Accordingly, referring to FIG. 6, an extension rebar 27 may be lowered from above the splice structure to a position above the sleeve. The ironworker swings the lower end of rebar 27 into contact with the upstanding wedge 12 to approximately align the extension rebar with sleeve 11 and dowel rebar 28. Rebar 27 is then inserted into sleeve 11 until its lower end engages the upper end of the dowel rebar 28. The engagement between rebars 27 and 28 is visible through the inspection holes 31. If the angle between the engaged rebar end surfaces appears excessive, the worker may be able to improve the seating of the extension rebar on the dowel rebar by rotating the extension rebar to a position of maximum engagement with the dowel bar.

With the rebars 27 and 28 in end-to-end engagement within sleeve 11, the sleeve is contracted to grip both rebars tightly and thereby complete the rebar joint. Thus, referring to FIG. 7, a hammer 30 is used to drive wedge 12 down until sleeve 11 firmly grips both the upper and lower rebars. The location tab 20 holds sleeve 11 in its proper centralized position relative to the engaged faces of the rebar ends until the sleeve is contracted into initial gripping engagement with the perimeters of the bars, ribs 21 and 22. After initial gripping engagement of the sleeve on either or both of the rebars, the area of the contact together with the constrictive pressure asserted is sufficient to maintain the sleeve in its proper position during the final driving of the wedge to increase the grip of the clamp on the bars.

The present invention, therefore, affords an improved clamp and method for splicing an extension rebar onto a dowel rebar to form a rebar joint in a vertical concrete body. Forming the location tab 20 in the clamp sleeve 11 is a simple and economical operation, which may be performed in the same stamping operation in which the apertures 24 and inspection hole 31 are punched out. The tab provides a sufficient bearing force against the side of a dowel rebar to maintain the vertical position of the sleeve while the joint is being assembled, thereby freeing the ironworker's hands for other operations. The advantages of the present invention are most evident from the labor savings resulting from their use.

Whereas prior to the introduction of preliminary clamping means, a three man crew was often used to construct the rebar joints (one to lower the extension rebar into place, one to hold the sleeve in position at the joint, and one to contract the sleeve), no more than two men need be utilized to construct joints using the clamp and method of the present invention. No bolts or set screws are used or needed. Moreover, driving of the sleeve onto the dowel rebar requires less time, effort and manual dexterity than the application of the screw-type clamp means of the prior art.

I claim:

1. The method of forming a rebar joint in a vertical column, wall, or like reinforced concrete body, comprising the following steps:

fabricating a clamp comprising a contractable metal sleeve having an unstressed internal diameter just large enough to receive a dowel rebar of given size and contraction means for contracting the sleeve, including the sub-step of forming a location tab, integral with the sleeve, having a free edge projecting upwardly and inwardly from the central portion of the sleeve at an acute angle;

sliding the metal sleeve onto the upper end of a lower dowel rebar until the tab engages the upper edge of the dowel rebar;

driving the metal sleeve further onto the upper end of the dowel rebar to bend the upper end of the location tab outwardly toward the sleeve until the free edge of the tab firmly engages the dowel rebar just below the upper edge of the rebar;

inserting an upper extension rebar into the sleeve until its lower end engages the upper end of the lower dowel rebar;

and contracting the sleeve, by means of the contraction means, to grip both the rebars tightly and thereby complete the rebar joint.

2. The method according to claim 1 including the sub-step of constructing the sleeve to have a circumference embracing the major portion of the circumference of the dowel rebar.

3. The method of forming a rebar joint, according to claim 1 wherein the contraction means is a wedge and the initial fabrication operation further includes the sub-steps of forming grout-receiving openings in both the sleeve and wedge and forming an inspection hole through the sleeve at a longitudinal position immediately above the upper end of the location tab; and further comprising viewing the engagement between the extension rebar and dowel rebar within the sleeve through the inspection hole; and rotating the extension rebar relative to the dowel rebar to obtain the best joint contact.

4. A clamp for clamping the upper end of a dowel rebar to the lower end of an extension rebar to form a rebar joint in a vertical column, wall, or like reinforced concrete body, comprising:

a contractible metal sleeve of circular section having a longitudinal split, and having an unstressed internal diameter just large enough to receive a given size rebar;

contraction means for pulling the opposed edges of the split in the sleeve toward each other to contract the sleeve into firm gripping relation with the end portions of a dowel rebar and an extension rebar extending into the sleeve from opposite directions;

and a location tab struck from a central portion of the sleeve and projecting upwardly and inwardly from the central portion of the sleeve at an acute angle, the sleeve material having a strength and thickness such that a substantial driving force, such as a forceful hammer below, is required to drive the sleeve onto a dowel rebar to a position in which the location tab is bent outwardly toward the sleeve enough to permit the tab to firmly engage the dowel rebar just below its upper edge.

5. A clamp, according to claim 4, wherein the metal sleeve is of greater circumference than semi-circular.

6. A clamp, according to claim 4, wherein the location tab is positioned generally diammetrically opposite the longitudinal slit in the sleeve and longitudinally immediately below the center of the sleeve.

7. A clamp, according to claim 6, further comprising a transverse center position line formed in the sleeve just above the top of the location tab.

8. A clamp, according to claim 4, wherein the contractable metal sleeve has an inspection hole therethrough longitudinally positioned with its center just above the location tab.

9. A clamp, according to claim 4, wherein the longitudinal split in the sleeve is defined by flanges along the longitudinal edges of the sleeve and wherein the contraction means comprises a wedge member having longitudinal flanges cooperative with the sleeve flanges to pull the opposed edges of the split sleeve together in response to forced lengthwise translation of the wedge onto the sleeve and wherein both the sleeve and wedge members are formed with grout-receiving openings extending therethrough.

* * * * *